US011622621B2

(12) United States Patent
Obioha

(10) Patent No.: US 11,622,621 B2
(45) Date of Patent: Apr. 11, 2023

(54) COLLAPSIBLE WORKSTATION

(71) Applicant: Kirian Obioha, Columbia, SC (US)

(72) Inventor: Kirian Obioha, Columbia, SC (US)

( * ) Notice: Subject to any disclaimer, the term of this patent is extended or adjusted under 35 U.S.C. 154(b) by 0 days.

(21) Appl. No.: 17/398,226

(22) Filed: Aug. 10, 2021

(65) Prior Publication Data

US 2023/0048692 A1 Feb. 16, 2023

(51) Int. Cl.

*A47B 3/00* (2006.01)
*A47B 21/06* (2006.01)
*A47B 3/10* (2006.01)

(52) U.S. Cl.

CPC ..... *A47B 3/002* (2013.01); *A47B 3/10* (2013.01); *A47B 21/06* (2013.01); *A47B 2021/066* (2013.01); *A47B 2200/0081* (2013.01)

(58) Field of Classification Search

CPC ..... A47B 3/002; A47B 3/10; A47B 21/06; A47B 2021/066; A47B 2200/0081
USPC ..... 108/23, 115, 50.01
See application file for complete search history.

(56) References Cited

U.S. PATENT DOCUMENTS 2,244,211 A * 6/1941 Nelson ..... A47B 3/10 312/282
2,433,748 A 12/1947 Eide
2,973,603 A 3/1961 De
5,088,420 A 2/1992 Russell
5,979,337 A * 11/1999 Clark ..... A47B 23/002 248/444
6,041,723 A 3/2000 Peterson
6,068,355 A 5/2000 Thorp
6,439,133 B1 8/2002 Jaramillo
6,450,106 B2 * 9/2002 McIntyre ..... A47F 11/10 108/92
7,032,522 B2 * 4/2006 George ..... A61B 5/742 108/50.01
D553,372 S * 10/2007 Henschel ..... D6/353
D566,856 S * 4/2008 Eveleth ..... A47B 3/14 D25/65
7,806,376 B2 * 10/2010 Song ..... A61B 5/00 108/50.01
7,828,253 B2 * 11/2010 Meyer ..... A47B 21/00 108/50.01
8,424,464 B2 4/2013 Korpi
8,671,853 B2 3/2014 Flaherty
8,935,985 B2 * 1/2015 Hjelm ..... A47B 21/06 108/50.01
D751,309 S * 3/2016 Habraken ..... D25/65
(Continued)

FOREIGN PATENT DOCUMENTS

ES 1192885 U * 10/2017 ..... A47C 12/00

*Primary Examiner* — Jose V Chen
(74) *Attorney, Agent, or Firm* — Southeast IP Group; Thomas L. Moses

(57) ABSTRACT

A collapsible work station is adapted to fold into a collapsed state for transport and storage purposes, and may be easily configured into an expanded working state to include a foldable flat work surface member on a top portion thereof, folding support members for supporting the flat work surface member, a file pouch, and various optional features such as one or more lights, drink holders, a coffee warmer, a battery to power charging stations for various electronic components, a flexible and adjustable mobile device holder, a pivoting handle member, a folding keyboard shelf, a carrying strap, and adjustable extending and retracting legs.

14 Claims, 3 Drawing Sheets

(56) References Cited

U.S. PATENT DOCUMENTS

| | | | | |
|---|---|---|---|---|
| 9,380,847 | B1 | 7/2016 | Kiilebrew | |
| 9,392,870 | B2 | 7/2016 | Suman | |
| 9,848,695 | B1 * | 12/2017 | Gauss | A47B 3/0809 |
| 9,854,904 | B2 | 1/2018 | Getz | |
| 10,905,231 | B1 * | 2/2021 | Horowitz | A47B 91/02 |
| 2002/0066630 | A1 | 6/2002 | Brown, Sr. | |
| 2003/0079661 | A1 | 5/2003 | Luu | |
| 2004/0226791 | A1 | 11/2004 | Levy | |
| 2005/0045072 | A1 * | 3/2005 | Rossini | A47B 21/0314 108/50.01 |
| 2005/0188899 | A1 | 9/2005 | Yovich | |
| 2006/0021550 | A1 * | 2/2006 | Sagol | B25H 1/04 108/115 |
| 2006/0225624 | A1 * | 10/2006 | Grace | A47B 3/002 108/26 |
| 2007/0007094 | A1 | 1/2007 | Smith | |
| 2007/0028812 | A1 * | 2/2007 | Dumond | A47B 23/04 108/36 |
| 2009/0261643 | A1 * | 10/2009 | Kay | A47C 9/10 297/335 |
| 2011/0056412 | A1 | 3/2011 | Grammer et al. | |
| 2011/0126739 | A1 | 6/2011 | Korpi | |
| 2012/0060724 | A1 | 3/2012 | Doss et al. | |
| 2012/0312196 | A1 * | 12/2012 | Newkirk | H02J 50/12 108/50.02 |
| 2013/0228103 | A1 * | 9/2013 | Eveleth | A47C 4/20 108/115 |
| 2014/0216873 | A1 * | 8/2014 | Torres Montes | A47B 85/06 190/11 |
| 2016/0015167 | A1 * | 1/2016 | Abu-Akel | A47B 21/02 248/161 |
| 2016/0022027 | A1 * | 1/2016 | Grace | A47B 3/002 108/164 |
| 2016/0135590 | A1 * | 5/2016 | Zaccai | A47B 13/023 108/150 |
| 2018/0035800 | A1 * | 2/2018 | Okeke | H04M 1/04 |
| 2018/0235359 | A1 * | 8/2018 | Reinhart | A47B 3/002 |
| 2019/0125074 | A1 * | 5/2019 | Cheng | H02J 7/0013 |
| 2019/0166987 | A1 | 6/2019 | Diaz et al. | |
| 2020/0146438 | A1 * | 5/2020 | Choi | A47B 3/06 |
| 2020/0163450 | A1 * | 5/2020 | Moore-Davis | A47B 3/10 |
| 2020/0391372 | A1 * | 12/2020 | Strempke | B25H 3/006 |
| 2021/0076815 | A1 * | 3/2021 | Taylor | A47B 3/06 |
| 2021/0085071 | A1 * | 3/2021 | Clores | A47B 23/06 |
| 2021/0177134 | A1 * | 6/2021 | Adams | B25H 3/02 |
| 2021/0245064 | A1 * | 8/2021 | Cragg | A47B 3/10 |
| 2021/0274928 | A1 * | 9/2021 | Hanks | A47B 23/041 |

* cited by examiner

COLLAPSIBLE WORKSTATION

BACKGROUND OF THE INVENTION

The present invention relates to a collapsible workstation that may be stored and transported in a collapsible state, and may be easily unfolded for use on a desktop or other work surface. More specifically, the present invention relates to a collapsible workstation that includes a collapsible main body member, storage space for files, documents and the like, and which may include a number of additional features, including drink holders, a recharging station, a smart device holder, a folding keyboard shelf, coffee warmer, one or more lights, extendible feet and a folding handle member.

There have been numerous efforts, over the years, to develop portable workstations for use while a user is traveling or working remotely. It would be desirable to provide a workstation that is collapsible, so that it may be transported or stored in a collapsed state, and may then be set up to accommodate various items used in day-to-day work, including laptop computers, files, handheld electronic devices such as mobile phones, etc. The following documents disclose some of these types of portable workstations, and these documents are hereby incorporated herein by reference, in their entireties:

U.S. Pat. No. 5,088,420 Work Station

A work station having a base the forward side of the base supports a pair of transversely spaced upward extending supports which extend obliquely through the space above the base, the supports supporting an upper platform and an intermediate platform above the base at least one of which is displaceable along the supports.

U.S. Pat. No. 6,041,723 Portable Collapsible Self-Assembling Desk

The portable collapsible self-assembling desk having a desktop, base unit, pivotal side supports, a tray and a lower shelf. The desk in its collapsed configuration allows for easy transportation and storage and can be carried by a handle in a suitcase-like manner. The desk in its erected configuration provides a substantially horizontal work space. The pivotal side supports are automatically extended to provide support to the desktop allowing the desk to be easily converted between the collapsed and erected positions. These two configurations allow the desk to be in a collapsed configuration providing a small footprint and occupying substantially less space than when in the erect position.

U.S. Pat. No. 6,068,355 Portable Workstation

A portable workstation or office foldable into a transportable unit including top and bottom parts hingedly connected to one another so that the top part is pivotable with respect to the bottom part between open and closed positions. A table top is disposed atop the bottom part and defines an upwardly facing work surface. The table top and bottom part together define an interior compartment for storing objects therein. The top part includes compartments configured for displaying and storing objects such as documents therein, and the workstation is adapted to secure objects on the work surface and adjacent the compartments during transport or storage of the workstation.

U.S. Pat. No. 6,439,133 Portable Table Device

A portable table device for providing an easy transportable table for laptop computers. The portable table device includes a tabletop support frame; and also includes a plurality of legs being hingedly attached to the tabletop support frame; and further includes a tabletop assembly being attached to the tabletop support frame; and also includes a beverage holder assembly including a tray being extendably mounted to the tabletop support frame; and further includes an elongate storage container being securely attached to the tabletop support frame; and also includes a fastener assembly for securing the portable table device in folded storable position.

U.S. Pat. No. 8,424,464 Portable, Collapsible, Workstation Tray Table Apparatus

An apparatus includes a surface panel for supporting objects in a first workspace. The surface panel includes a removable plug having a first flat surface and a second surface comprising rectilinear fingers for supporting devices in a generally upright position. A frame having a top side and a bottom side holds the surface panel above the top side and enables the surface panel to be positioned at a plurality angles relative to the frame. Appendages joined to the frame and deployable from the frame enable the frame and the surface panel to be supported a distance above a surface, where the distance is sufficient for enabling a second workspace between the frame and the surface.

U.S. Pat. No. 8,671,853 Adjustable Desktop Platform

An adjustable desktop workspace is disclosed having a base having a lower platform, an upper platform, and two pivoting arms mounted between the two. Each pivoting arm has a front and rear bracket. A locking lever on each arm fixedly engages the platform in an upright position at a variety of levels above the lower platform. There are also two stabilizing bars to limit side-to-side relative movement, and a biasing spring between the front and rear brackets to aide moving the upper platform.

U.S. Pat. No. 9,380,847 Mobile Work Station System

A mobile work station system which is adapted to be utilized in a wide range of locations for a wide range of uses, such as functioning as an eating table, work area, computer desk, television stand and the like. The mobile work station system generally includes a case including a first portion and a second portion. The first portion is hingedly secured to the second portion. A pair of cup holders extend from either side of the first portion for storing various beverages therein. A pair of dry-erase boards extend from either side of the second portion in a retractable manner. An attachment receiver is positioned on the lower end of the first portion for attaching a tripod attachment. A pair of mounting members are positioned within a slot formed in the second portion for suspending the present invention from various structures, such as a fence.

U.S. Pat. No. 9,392,870 Adjustable Laptop Support for Electronic Devices

A height-adjustable support apparatus supports items above a user's lap while seated or reclining. The apparatus includes a bottom panel with optional pillow for resting on a seated user's lap, a top panel with upright rests configured to support items (such as electronic devices) at a desired angle of use, a four-bar linkage for moving the top panel between height-adjusted positions while maintaining a same horizontal orientation, and a lock engaging slots in the bottom panel for fixing a selected height-adjusted position of the top panel. Rests on the top panel are made of bent wire and can be selectively pivoted to upright positions for supporting devices, such as a cell phone, tablet computers, books, game displays, etc. A cup holder engages a rest on the top panel to support either a handled container (such as a mug) or no-handle container (such as a soda can).

U.S. Pat. No. 9,854,904 Portable Workstation Assembly

A portable workstation assembly for coupling a computer desk to a table top includes a table unit that may be removably coupled to a horizontal support surface. Thus, the table unit may support an object. A tray unit is slidably coupled to the table unit and the tray unit may support an object. The tray unit is positionable between a stored position and a deployed position with respect to the table unit.

U.S. Patent Application No. US20020066630 Multi-Configurable Portable Desk Companion A multi-configurable portable desk or table companion that is adjustable to permit it to be folded for transport and configured to one of a desk state, podium state, easel state, music stand or artist table state. The desk companion can be used also to support a laptop. The multi-configurable portable desk companion includes two arm members angularly adjustable via a lever-operated adjustment clamp and a multi-positionable desktop surface angularly adjusted by a lever-operated adjustment clamp. The two arm members are coupled to a collapsible tripod leg assembly to vary the height of the multi-positionable desktop surface. Furthermore, the multi-configurable portable desk or table companion is adapted to be used as a table tray, night stand, or other furniture for use in the home or office.

U.S. Patent Application No. US20030079661 Foldable and Portable Table

A lightweight, collapsible table is disclosed which includes a main body which has tracks to receive slideable legs and slideable auxiliary members. The table top is hinged to allow an angled useful orientation. The various portions of the table are slideable and/or foldable into the body to provide a very compact, easy to transport assembly when the table is not in use. The body includes hinges which allows the table top to be rotated and a stand to hold the table top in an angled position as desired by a user. Auxiliary members slideably engage the body to allow the user access thereto when the table is in use. The legs are also slideably engaged within the body and include a positive stopping mechanism so that a user may adjust the width (i.e., spacing) of the legs. Additionally, the legs are extendable such that the height of the table may be adjusted by the user.

U.S. Patent Application No. US20040226791 Covertible Laptop PC Bag to Workstation with Legs A laptop pc bag provides not only a standard laptop carrying case for carrying and protecting a laptop PC but also a desk. The height of the bag can be adjusted by extending the legs as far as desired, from approximately six inches to thirty-six inches, thereby providing the right height of the desk for the user. This allows users of all ages and sizes to take advantage of bag in its desk format, regardless of where they are. The legs ultimately provide the user more freedom with their laptop PC and will allow the user to perform the tasks at hand in an easier and more comfortable manner than previously possible. A considerably more versatile laptop bag is provided, one that can be transformed from a normal standard laptop carrying case into a portable workstation, for today's more versatile user and workplace.

U.S. Patent Application No. US20050188899 Work Surface Device

A light-weight, portable, work surface device that functions as a lap desk, a work surface for a laptop computer, a bed tray, a book holder, a music stand, and a painting easel, for example is described. A first panel supports a workpiece, a second panel functions as an elevator support between the first and third panel, while the third panel serves a base. The rotably hinged three panels may be securely positioned at various work angles relative to each other and folded against each other. The device also provides a support for maintaining the workpiece at convenient positions on the first panel, and at least one receptacle adapted for holding a work tool, such as a pen, and at least one holder for holding a container, such as a cup. The base of the device is shaped to conform to a shape of a person's lap.

U.S. Patent Application No. US20070007094 Suitcase and Desk Combination Device

A suitcase and desk combination device includes a housing that has a bottom wall, a top wall and a peripheral wall that is attached to and extends between the top and bottom walls. The peripheral wall has a break therein and that defines an opening for accessing an interior of the housing. The bottom wall has a bottom edge, a top edge, a first lateral edge and a second lateral edge. The bottom wall is substantially planar. Each of a plurality of legs extends into the top wall. Each of the legs has a free end and each of the legs is selectively telescoping so that the free ends may be selectively positionable in a stored position adjacent to the top wall or in an extended position extending away from the top wall.

U.S. Patent Application No. US20070028812 Portable Table for a Laptop Computer

This invention is directed to a portable table which is formed in two half sections movable between a folded position where they form a brief case and an unfolded position in which the half sections abut one another to define a planar table top capable of supporting a laptop computer, notebook and the like. The table top has a pair of legs which are adjustable both in the vertical and lateral directions.

U.S. Patent Application No. US20110056412 Devices for Providing a Workstation and Methods of Marking and Using the Same The invention provides a device, and method of making and using the device, for providing at least one work surface. The device may include (a) a base portion that includes an upper base portion and a lower base portion, the upper base portion and the lower base portion forming a base portion cavity disposed there between; and (b) at least one base portion extension, each base portion extension attached to the base portion, each base portion extension movable between a stored position in which the base portion extension is mostly disposed in the base portion cavity, and an extended position, in which the base portion extension is mostly extended out from the base portion so as to form a working surface. The at least one base portion extension may include four base portion extensions. The device may further comprise a work surface assembly, the work surface assembly pivotally disposed upon the base portion so as to form a work surface such that the angle of the work surface may be varied. Yet further, the device may further comprise a leveling assembly, the leveling assembly pivotally disposed under the base portion and attached to the lower base portion, the leveling assembly pivotally disposed such that the angle that the base portion is disposed upon a surface may be varied.

U.S. Patent Application No. US20110126739 Portable, Collapsible, Workstation Tray Table Apparatus An apparatus includes a surface panel for supporting objects in a first workspace. The surface panel includes a removable plug having a first flat surface and a second surface comprising rectilinear fingers for supporting devices in a generally upright position. A frame having a top side and a bottom side holds the surface panel above the top side and enables the surface panel to be positioned at a plurality angles relative to the frame. Appendages joined to the frame and deployable from the frame enable the frame and the surface panel to be supported a distance above a surface, where the distance is sufficient for enabling a second workspace between the frame and the surface.

U.S. Patent Application No. US20120060724 Mobile Computer Lapdesk

A mobile computer lapdesk is provided, which includes a desk portion and soft-goods member coupled to a bottom side of the desk portion. The desk portion includes a desk surface and an adjustable member operatively coupled to the desk surface, wherein a mobile computer is coupled to the adjustable member in one of a portrait or a landscape orientation. The adjustable member may also include audio recesses, wherein the audio recesses provide passive sound amplification in response to coupling a mobile computer to the rotatable member with the audio recesses adjacent speakers of the mobile computer.

U.S. Patent Application No. US20190166987 Utility Cart Portable Plans Table

A portable plans table configured to be used with a utility cart. The tabletop can be a non-fold table top, a mono-fold table top, or bi-fold table top that is large enough to support building plans, blueprints and the like. Each tabletop comprises leg members. The leg members can be panel leg members, a rotatable leg assembly, separate legs, or tubular folding legs. The embodiments of the plans table comprise various combinations of the different tabletops and leg members. Each plans table embodiment can easily fold and be carried from one site to another.

BRIEF SUMMARY OF THE INVENTION

In accordance with one aspect of the invention, a first embodiment of a collapsible workstation includes a folding main body member, which includes a flat work surface member that is oriented in a generally horizontal plane when the work station is in its uncollapsed, working state, and preferably includes a hinge member along a center line thereof, so that the work surface member may be folded in half when not in use. A pivoting handle is preferably disposed adjacent the hinge member on the work surface, which may include an indentation to receive the handle in order to provide a flat plane for the work surface while the workstation is in use. The front and rear vertical support panels are pivotally connected to the front and rear edges of the work surface member. The workstation also includes a pair of folding sides, which are pivotally connected to the vertical panels, and each folding side includes a hinge member that is oriented vertically along a center line thereof, when the workstation is in its uncollapsed, working state. In order to collapse the workstation, the folding sides are folded inwardly towards each other, and the work surface member folds upwardly to provide access to the handle.

The collapsible workstation may also include one or more drink holders, a coffee warmer, one or more pouches for holding or storing files, documents, electronic devices, and the like, a flexible light, telescoping and folding legs, a folding keyboard shelf, a recharging station with USB ports and a wireless mobile phone charger, a mobile device holder (which is preferably adjustable to accommodate phones or other electronic devices of different sizes), and other optional features, as desired.

BRIEF DESCRIPTION OF THE DRAWINGS

These and other features, aspects, and advantages of the present invention will become better understood with regard to the following description, appended claims, and accompanying drawings where:

DETAIL DESCRIPTION OF THE INVENTION

Overview

Figure 1:
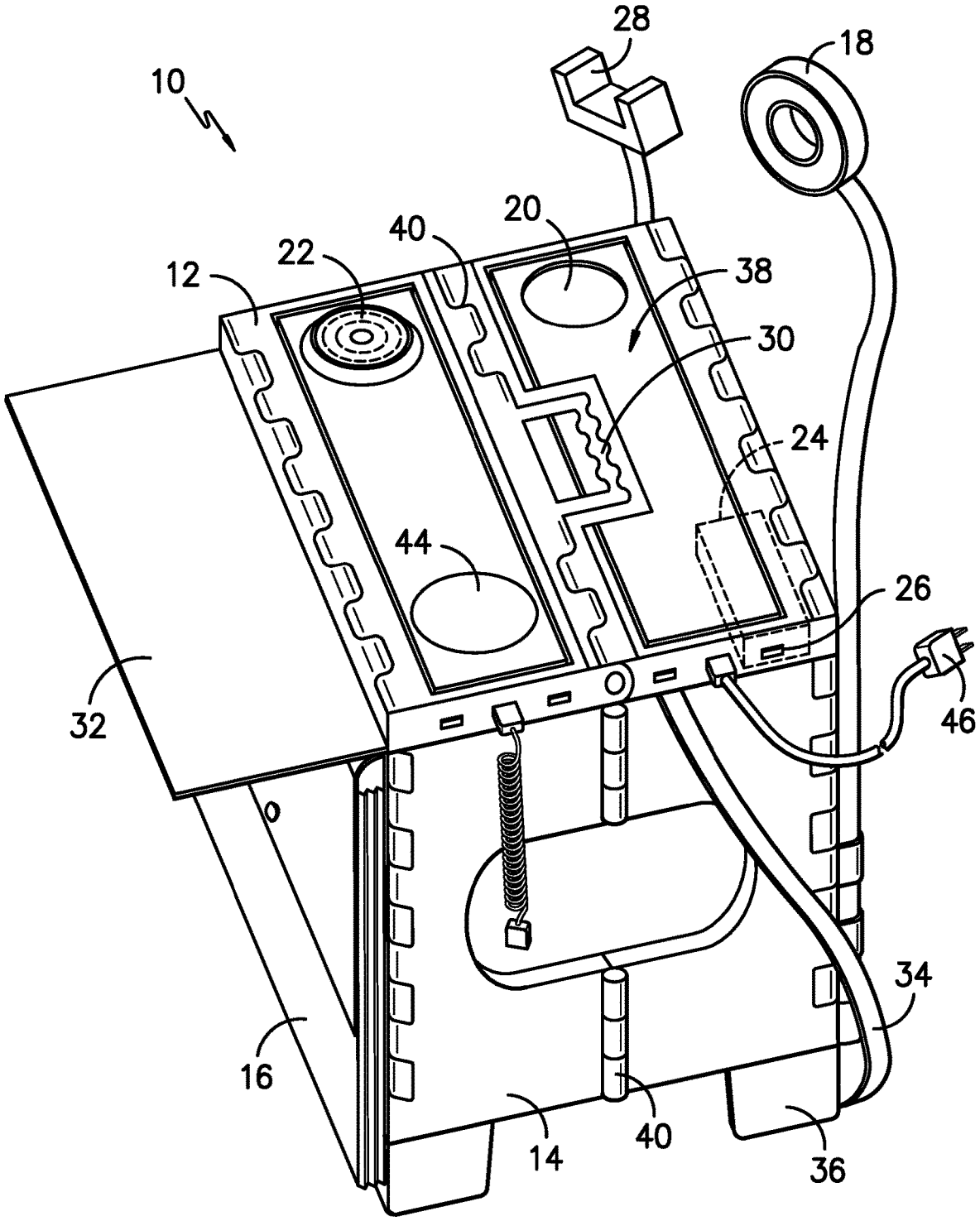
FIG. 1 is a perspective view of one embodiment of the collapsible work station, wherein the collapsible work station has a foldable flat work surface member on a top portion, a pair of folding sides, a file folder, extended foldable keyboard shelf, carrying strap, retractable legs, and various optional features.
Figure 2:
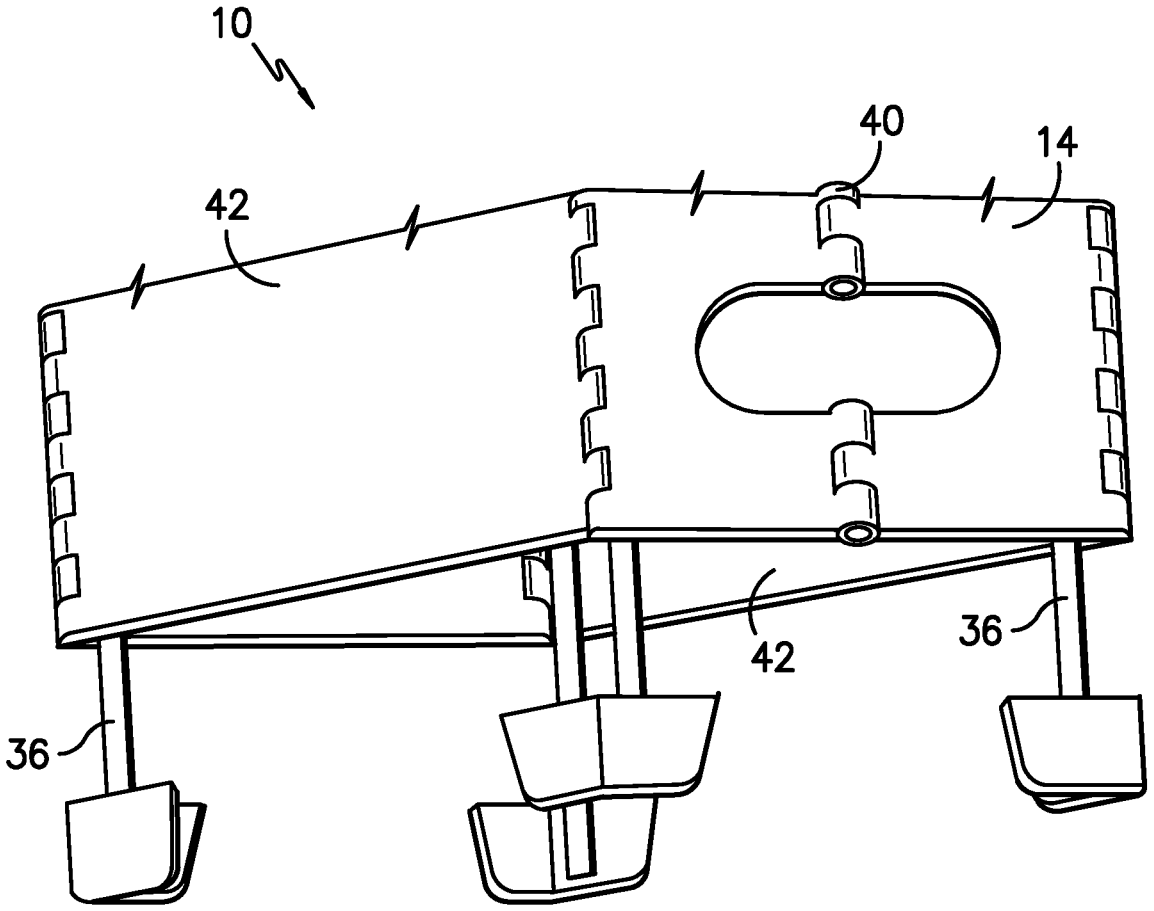
FIG. 2 is a perspective view of one embodiment of the collapsible work station, wherein legs of the collapsible work station are extended outwardly.

The present invention includes, in a first embodiment, a collapsible work station 10 that folds into a collapsed state for transport and storage purposes, and which may be easily set up to accommodate various accoutrements for work, including a foldable flat work surface member 12 on a top portion thereof, a pair of folding sides 14 for supporting the flat work surface member 12, a file folder 16, and various optional features such as one or more lights 18, drink holders 20, a coffee warmer 22, a battery 24 to power charging stations 26 for various electronic components, a flexible and adjustable mobile device holder 28, a pivoting handle member 30, a folding keyboard shelf 32, a carrying strap 34, and adjustable extending and retracting legs 36.

Main Body Member a first embodiment of a collapsible workstation 10 includes a folding main body member 38, which may be folded into a generally flat configuration for storage and transport purposes, and which may be easily expanded and configured to a working state so that a user may place a laptop computer and keyboard on it for work purposes.

The main body member 38 includes a flat work surface member 12 on an upper portion thereof that is oriented in a generally horizontal plane when the work station 10 is in its uncollapsed, working state, and preferably includes a hinge member 40 along a center line thereof, so that the work surface member 12 may be folded in half when not in use. A pivoting handle 30 is preferably disposed adjacent the hinge member 40 on the work surface 12, which may include an indentation to receive the handle 30 in order to provide a flat plane for the work surface 12 while the workstation 10 is in use. The front and rear vertical support panels 42 are pivotally connected to the front and rear edges of the work surface member 12. The workstation 10 also includes a pair of folding sides 14, which are pivotally connected to the vertical support panels 42, and each folding side 14 includes a hinge member 40 that is oriented vertically along a center line thereof, when the workstation 10 is in its uncollapsed, working state. In order to collapse the workstation 10, the folding sides 14 are folded inwardly towards each other, and the work surface member 12 folds upwardly to provide access to the handle 30. Conversely, the workstation 10 may be transformed from its collapsed state into an uncollapsed, working state by placing the bottom portion of the main body member 38 on a flat surface and pushing downwardly on the centrally disposed handle member 30 (or pushing downwardly on the upwardly folded flat surface member 12), which causes the surface member 12 to flatten out into a horizontal plane, and also causes the two folding sides to expand and form generally flat vertical sides in the working state.

Battery Recharging System

A battery recharging system may be incorporated into the collapsible workstation 10, and includes, in one embodiment, a battery 24, a power cord that may be plugged into a wall outlet or a USB port to recharge the battery 24, and a series of USB ports 26 connected to the battery 24 for recharging electronic devices. The power cord may be plugged in to recharge the battery 24 while the collapsible work station 10 is either in the collapsed state or the uncollapsed state, and the battery 24 may also be used to power other optional features, including one or more lights 18, a coffee warmer 22, a wireless mobile phone charger 44, or the like. The power cord 46 may also be detachable from the battery 24, or may be extendable and retractable, as is well known in the art.

In one embodiment, a series of retractable cords may be operationally connected to the battery 24, so that the cords may be extended for use while recharging electrical items, and may be retracted into a housing when not in use. Retractable cord assemblies are well known in the art, and may be easily incorporated into the battery recharging system of the present invention.

Other Optional Features

The collapsible workstation 10 may also include other additional features. For example, as shown in FIG. 1, a wireless mobile phone charger 44 may be positioned on the flat work surface member 12. Similarly, a coffee warmer 22 may be positioned on the flat work surface member 12, as well. One or more lights 18 may be attached in any desired manner to the collapsible workstation 10. In one embodiment, an LED light 18 having a flexible gooseneck arm is attached to the main body member 38, as shown in FIG. 1. It should be understood that these electrical components may be powered by the above-referenced battery 24, an internal battery devoted solely to individual electrical appliance or component, or may be plugged into a separate battery, power source or wall outlet.

In one preferred embodiment, a folding keyboard shelf 32 may be attached to the the front vertical panel 42, so that the keyboard shelf 32 may be folded downwardly to maintain a low profile for transport and/or storage, and may be folded upwardly to a generally horizontal configuration when a keyboard is in use by a user. Preferably, the keyboard shelf 32 includes a suitable temporary locking mechanism for maintaining the keyboard shelf 32 in the generally horizontal position, and such locking mechanisms for folding shelves are well known in the art.

Figure 3:
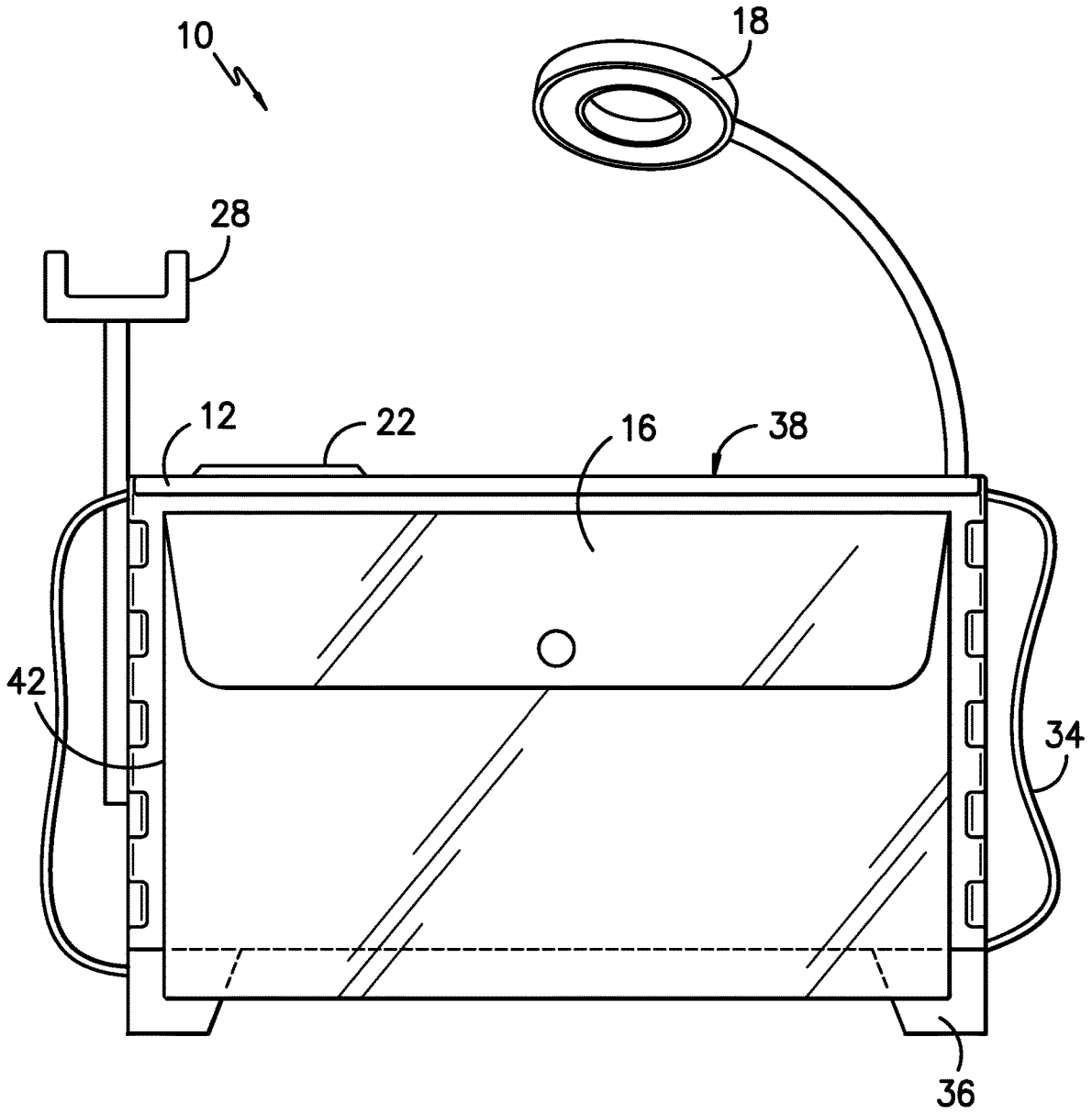
FIG. 3 is a front view of one embodiment of the collapsible work station, wherein the collapsible work station includes a file folder attached to the front vertical support panel and wherein a wireless mobile phone charger and a LED light are attached to the collapsible work station via flexible gooseneck arms.

An expandable file folder 16 may also be attached, preferably to either the front vertical panel 42 (as shown in FIGS. 1 and 3) or the rear vertical panel 42 for storing and transporting files, documents, papers and the like. In a preferred embodiment, the file folder 16 is made of a durable plastic material, and includes a folding flap with a securing mechanism (such as a snap-fit latch, or the like) for temporarily securing the flap in a closed position over the opening in the file folder, in order to maintain files and other items within the file folder.

Additionally, one or more drink holders 20 may be included with the collapsible work station 10. In one embodiment, the drink holder 20 may simply be an appropriately sized hole defined by the flat work surface 12, as shown in FIG. 1, to receive standard sized cups, glasses and the like.

Another option that may be included with the collapsible work station 10 is a flexible, adjustable mobile device holder 28, as shown in FIGS. 1 and 3. In a preferred embodiment, the mobile device holder 28 includes a flexible gooseneck stem that is attached to the main body member 38 in any desired location, and includes an adjustable mechanism to extend or retract the width thereof, in order to accommodate phones or other electronic devices of various sizes.

Additional pouches and/or compartments may be attached to the main body member 38 for transporting and storing miscellaneous items, such as writing implements, paper clips, calculators, or any other desired items. Further, adjustable legs 36 may be attached to the main body member 38, preferably at or adjacent the four corners thereof where the front and rear vertical panels 42 are pivotally connected to the two folding sides 14. These legs 36 may be extended downwardly while the workstation 10 is in use, in order to provide additional height of the main body member 38, and the legs 36 may be retracted when the work station 10 is not in use, or during storage and/or transportation.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A collapsible workstation comprising:

a main body member comprising a folding work surface on a top portion thereof, said folding work surface having a hinge member extending through a central portion thereof, a front vertical support panel pivotally attached to a first edge of said folding work surface, a rear vertical support panel support panel pivotally attached to a second, opposed edge of said folding work surface, and a pair of folding vertical sides, each folding vertical sides having a hinge member extending through a central portion thereof, wherein each folding vertical side is pivotally attached to an edge of said front vertical support panel and an edge of said rear vertical support panel;

wherein said main body member may be folded into a collapsed configuration by folding said folding work surface upwardly and said folding vertical sides inwardly; and wherein said main body member may be unfolded into a working configuration by unfolding and flattening said folding work surface into a horizontal plane and simultaneously unfolding each of said folding vertical sides, so that each folding vertical side forms a vertical plane.

2. The collapsible workstation set forth in claim 1, further including a battery recharging system attached to said main body member, said battery recharging system comprising a rechargeable battery that is operationally connected to at least one USB receptacle.

3. The collapsible workstation set forth in claim 2, further including a power cord that is operatively connected to said battery, and which may be plugged into a standard electrical outlet.

4. The collapsible workstation set forth in claim 3, wherein said power cord is extendable and retractable from a housing attached to said main body member.

5. The collapsible workstation set forth in claim 2, further including at least one retracting electrical charging cord operatively connected to said battery.

6. The collapsible workstation set forth in claim 1, further including a drink holder positioned on said main body member.

7. The collapsible workstation set forth in claim 1, further including a pivoting handle member attached to said folding work surface.

8. The collapsible workstation set forth in claim 1, further including an expandable file folder attached to said main body member.

9. The collapsible workstation set forth in claim 1, further including a light having a flexible gooseneck stem, said gooseneck stem being attached to said main body member.

10. The collapsible workstation set forth in claim 1, further including a coffee warmer disposed on said folding work surface.

11. The collapsible workstation set forth in claim 1, further including a flexible and adjustable mobile device holder attached to said main body member.

12. The collapsible workstation set forth in claim 1, further including a keyboard shelf pivotally attached to said main body member.

13. The collapsible workstation set forth in claim 1, further including a plurality of adjustable legs that may be extended or retracted, said adjustable legs being attached to said main body member.

14. The collapsible workstation set forth in claim 1, further including a strap member attached to said main body member for transport purposes.

* * * * *